US007634935B2

(12) United States Patent
Mazzocchi

(10) Patent No.: US 7,634,935 B2
(45) Date of Patent: Dec. 22, 2009

(54) QUICK UPPER TOOL COUPLING AND UNCOUPLING DEVICE OF A PRESS BRAKE

(75) Inventor: Domenico Mazzocchi, Piacenza (IT)

(73) Assignee: Rolleri S.p.A., Vigolzone (IT)

( * ) Notice: Subject to any disclaimer, the term of this patent is extended or adjusted under 35 U.S.C. 154(b) by 500 days.

(21) Appl. No.: 11/543,479

(22) Filed: Oct. 5, 2006

(65) Prior Publication Data

US 2008/0083259 A1 Apr. 10, 2008

(51) Int. Cl.
*B21D 5/02* (2006.01)
*B21D 37/04* (2006.01)

(52) U.S. Cl. ..... 72/482.91; 72/481.1; 72/481.6; 72/482.92; 72/389.3; 72/389.6

(58) Field of Classification Search ..... 72/389.3, 72/389.4, 389.6, 481.1, 481.2, 481.6, 481.7, 72/481.8, 482.6, 482.91, 482.92, 482.94
See application file for complete search history.

(56) References Cited

U.S. PATENT DOCUMENTS 2,105,391 A * 1/1938 Almdale ..... 72/482.91
5,245,854 A 9/1993 Bruggink et al.
5,284,069 A * 2/1994 Wellman ..... 72/482.91
6,732,564 B2 * 5/2004 Runk et al. ..... 72/481.1
6,843,760 B2 * 1/2005 Akami et al. ..... 72/482.91
6,928,852 B2 * 8/2005 Enderink ..... 72/481.1
7,021,116 B2 * 4/2006 Harrington et al. ..... 72/482.91
7,168,286 B1 * 1/2007 Pelech ..... 72/482.92
7,308,817 B2 * 12/2007 Shimota et al. ..... 72/482.1
7,325,428 B2 * 2/2008 Bruggink ..... 72/481.1
2006/0277970 A1 * 12/2006 Pabich et al. ..... 72/481.1

FOREIGN PATENT DOCUMENTS

DE 3524694 A1 1/1987
EP 0 497 714 A1 7/1992
JP 6-182447 7/1994
JP 10-277647 10/1998

* cited by examiner

*Primary Examiner*—David B Jones
(74) *Attorney, Agent, or Firm*—Pearne & Gordon LLP

(57) ABSTRACT

The rapid coupling and uncoupling device consists essentially of a plunger element (12) capable of being inserted into the clamp (4) or into the top beam/intermediary (1) of the same press brake, or into the tool connection (2), having a cursor (14) with a terminal part of a tapered form pressed by a spring to engage within a groove (16) present in the tool connection or in the clamp or in the top beam/intermediary, respectively.

28 Claims, 5 Drawing Sheets

QUICK UPPER TOOL COUPLING AND UNCOUPLING DEVICE OF A PRESS BRAKE

Figure 1:
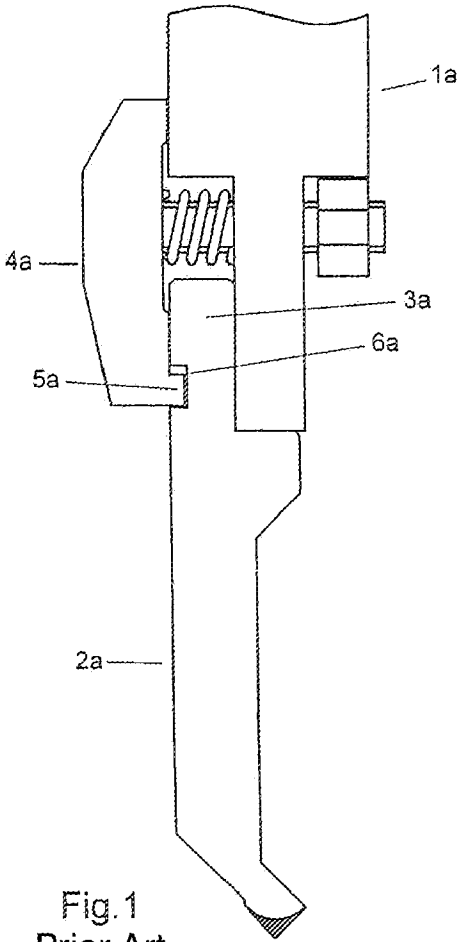
Fig.1 Prior Art

The present invention refers to a quick upper tool coupling and uncoupling device of a press brake.

PRIOR ART

Press brakes are normally fitted with a safety device to prevent installed upper tools from falling off, whenever the tool clamps are placed in an opening position.

Because of the presence of such a fall-preventing safety device, the assembling and disassembling of a tool to the top beam or to an intermediary (extension unit of the tool connection fitted between tool connection and top beam) occurs in a horizontal direction, meaning that the tool, with the tool connection clamp in an opening position, is allowed to slide laterally along the cavity of the top beam or the intermediary in which the tool connection is inserted.

As this need for a tool sliding motion in a horizontal direction renders the machine setting-up periods rather lengthy, fall-preventing safety devices have been developed so as to be capable of allowing tool assembly and disassembly in a vertical direction, and therefore a notable reduction of machine setting up time. However, most of these solutions require an additional installation of a pneumatic or hydraulic tool assembling and disassembling system, thus considerably inflating the operating costs.

Wholly mechanical systems for vertical tool assembling and disassembling tools are also available. However, these are rather complex and force the operator to hold the punch with a single hand during the uncoupling step, while having to use the other hand to actuate a device capable of uncoupling the tool. One of these latter systems, shown below in reference to FIG. 2A, is described in document EP 494 714.

SCOPE OF THE INVENTION

The scope of this invention is to create a quick tool coupling and uncoupling device of a press brake, capable of consenting at least one of the following advantages:

- have a rather simple structure,
- allow it to be installed without appreciably affecting the structure of the tool and of the press brake and/or intermediary,
- allow it to be installed on a vast range of press brakes and tools, and to update existing press brakes by applying small modifications to the existing tools and/or clamps,
- allow it to also be utilized on tools weighing over 12.5 kg,
- allow it to be utilised even on tools of little dimensions,
- allow the tool, upon detaching, to be grasped in the most appropriate manner, without simultaneously actuating any releasing device.

SUMMARY OF THE INVENTION

The invention refers to a quick upper tool coupling and uncoupling device of tools to the top beam of a press brake, where each tool can be attached to the top beam or to an intermediary, by clamping/unclamping clamps. The device is characterized by the presence of a plunger comprising:

- an outer seat, fitted with an aperture on one side,
- a cursor capable of sliding within said seat, with a terminal part of a tapered shape, and capable of partially projecting said terminal part outside said aperture,
- a spring pressing the cursor to project outside said aperture with said terminal part.

It is also characterized by the presence of a groove with a horizontal axis parallel to the front of the press, which is allocated:

- according to a first variant, on a vertical surface of the part of the tool connection inserted into the cavity of the top beam or of the intermediary destined to seat the tool connection;
- according to a second variant, on the top beam or on the intermediary, inside the cavity seating the tool connection,
- according to a third variant, on the clamp assembling/disassembling the tool, inside the cavity seating the tool connection.

It is further characterized in that the plunger is allocated:

- according to said first variant, inside the clamp clamping/unclamping the tool or inside the top beam or inside the intermediary, with its aforesaid aperture opening up to a part of the surface of the clamp or of the top beam or of the intermediary, which is opposite said groove when the tool is installed,
- according to said second and third variant, inside the tool connection, with its aforesaid aperture opening up to a part of the tool connection surface, which is opposite said groove when the tool is installed.

It is further characterized in that:

- the plunger is placed so as to allow the aforesaid terminal part of the cursor to enter within said groove and push against a rim of the groove, so as to prevent the tool from falling off, while the spring is chosen and calibrated so that, when said terminal part is in contact with the groove in its innermost entry position, the pressure exerted by it on the cursor is such as to prevent the tool from falling off, when the relative clamp is in a releasing position,
- said groove rim is in the first variant the upper rim, while in the second and third variant is the lower rim.

DRAWINGS

Figure 2:
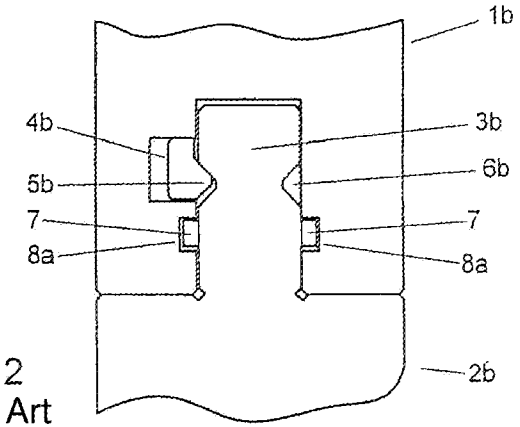
Fig.2 Prior Art
Figure 2A:
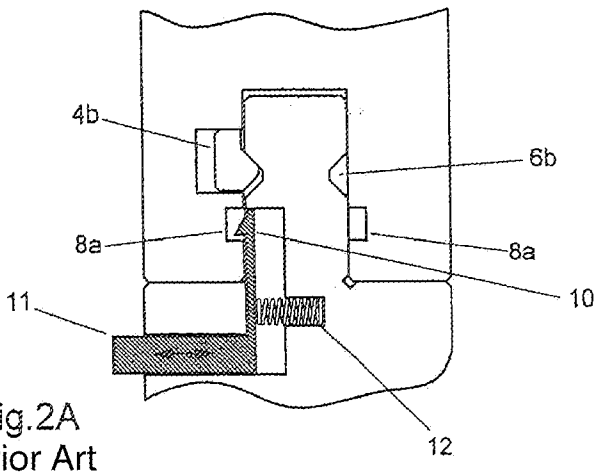
Fig.2A Prior Art
Figure 3:
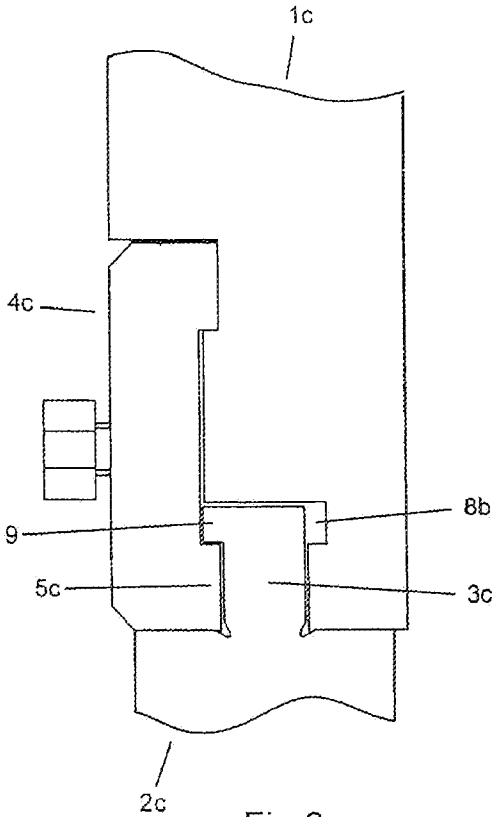
Fig.3 Prior Art

The characteristics and advantages of the invention will be more evident from the following description relating to a few preferred embodiments of a non limiting nature and drawn up with reference to the enclosed drawings, whose figures show:

FIGS. 1, 2, 3: typical examples of tool connections to a press top beam, providing tool assembling and disassembling operations in a lateral direction, FIG. 2A: a known device allowing the connection of FIG. 2 to be modified into a connection of a frontal type, meaning that it allows coupling and uncoupling of the tool in a vertical direction, FIGS. 4, 5, 6, 7, 8: preferred examples of embodiment of the invention according to several variants, FIGS. 9, 9A, 9B, 9C: application examples of the invention, capable of converting a connection of a lateral type such as in FIG. 2 into a frontal connection;

FIGS. 10, 10A, 10B, 10C, 10D: application examples of the invention, capable of converting a connection of a lateral type such as in FIG. 1 into a frontal connection, FIGS. 11, 11A, 11B, 11C, 11D: application examples of the invention, capable of converting a lateral connection such as in FIG. 3 into a frontal connection.

DESCRIPTION OF THE PREFERRED EMBODIMENTS

The FIGS. 1, 2, 3 show typical examples of connections of a tool to the top beam or to the intermediary of a press brake, connections that provide coupling and uncoupling operations of the tool which require a sliding motion of the tool in a lateral direction.

The various symbols in the figures represent:

1*a*, 1*b*, 1*c*: top beams or intermediaries of the press,

2*a*, 2*b*, 2*c*: tools,

3*a*, 3*b*, 3*c*: tool connections,

4*a*, 4*b*, 4*c*: tool clamps on the top beam or on the intermediary,

5*a*, 5*b*, 5*c*: reliefs extending along the lower rim of the clamp,

6*a*, 6*b*: reliefs extending along a flank of the tool connection,

7: cylindrical pins fastened to the flanks of the tool connection,

8*a*, 8*b*: grooves present on the top beam,

9: relief projecting from a flank of the tool connection.

In FIG. 1 the safety device against the falling of the tool is represented by the parts 5*a* and 6*a*. When the tool connection is released as a result of unclamping the clamp 4*a*, the tool 2*a* will in fact not fall, as the relief 5*a* remains engaged in the groove 6*a*. In order to disassemble the tool, the same must be made to slide horizontally along the front of the press, until the groove 6*a* disengages from the relief 5*a*.

In FIG. 2 the safety device against the falling of the tool is represented by the parts 7 and 8*a*. When the tool connection is released after unclamping the clamp 4*b*, the tool 2*b* will in fact not fall, as the cylindrical pins 7 remain engaged in the grooves 8*a*. Even in this case, a disassembling of the tool requires that it be made to slide horizontally along the front of the press, until the groove 8*a* disengages from the pins 7.

In FIG. 3 the safety device against the falling of the tool is represented by the parts 5*c* and 9. When the tool connection is released after unclamping the clamp 4*c*, the tool 2*c* will not fall, as the relief 9 remains engaged with the relief 5*c* (if the tool were mounted with the relief 9 to the right, it would not fall because of its engagement with the groove 8*b*). In order to disassemble the tool, it must be made to slide horizontally along the front of the press, until the relief 9 disengages from the relief 5*c*.

FIG. 2A schematically shows a section view of a known device which allows modifying the lateral type connection in FIG. 2 into a front type connection, meaning that it allows tool coupling and uncoupling operations in a vertical direction. According to this device, the pins 7 are eliminated and replaced by a tooth 10 capable of horizontally sliding within a cavity of the tool connection, and of being pressed by a spring 12 to remain in an engaged position with one of the two cavities 8*a*. When the clamp 4*b* is shifted to the left into a releasing position, the tool will not fall because of said engagement.

In order to deactivate the fall-preventing device, the push-button 11 must be pressed (so as to disengage the tooth 10 from the cavity 8*a*) and the tool must at the same time be supported with one hand, to prevent it from falling. The tool, supported by the operator by hand, may then be disassembled with a vertical motion toward the bottom.

The FIGS. 5, 6, 7, 8 schematically show schematic view of preferred forms of embodiment of the invention according to several variants.

Each of these figures schematically shows the lower extremity 1 of the top beam of a press (or of an intermediary installed there), the upper extremity 2 of an installed tool, a clamp 4, and a rapid coupling and uncoupling device according to the invention, essentially consisting of a plunger element 12 capable of being inserted into the clamp 4 or into the tool connection 2 or into the top beam/intermediary, comprising a cursor capable of sliding and having a terminal part of a tapered form, capable of engaging within a groove (16, 17, 18, 19) present in the tool connection, or in the clamp, or in the top beam/intermediary, respectively.

Figure 4:
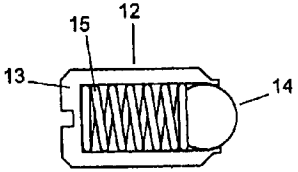

In particular, the plunger element 12, shown in FIG. 4 on an enlarged scale according to a preferred form of embodiment, comprises:

- a seat 13 with an aperture on one side,
- a metallic cursor 14 with the shape of a sphere, capable of sliding within said seat and of partially projecting from said opening with a part acting as a tip,
- a spring 15 pressing the cursor to project from said aperture with said tip.

According to the aforesaid preferred embodiment, said seat has a cylindrical form. It could however also be of another form, for instance of a prismatic form.

The cursor spherical form is also not essential. It could in fact be a cursor with a terminal part of a differently tapered form, for instance a cylindrical form, or with a vertical cross-section having the shape of a V or of an isosceles trapeze.

Figure 8:
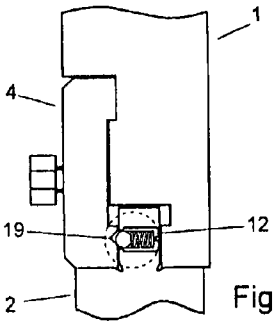
Figure 8A:
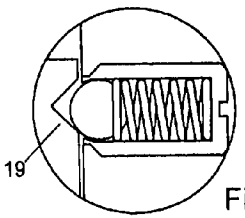
Figure 7B:
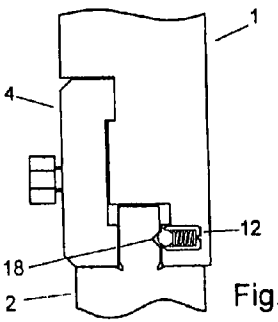
Figure 7:
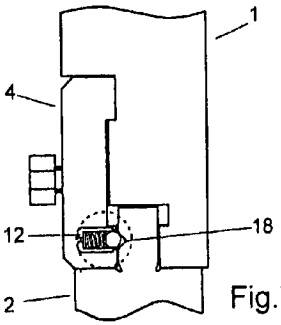
Figure 7A:
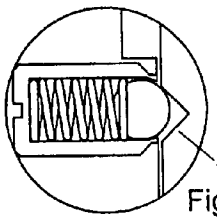
Figure 6:
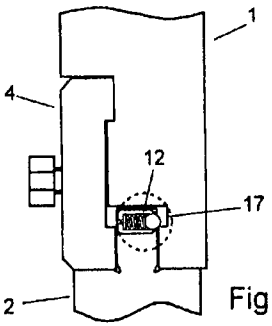
Figure 6A:
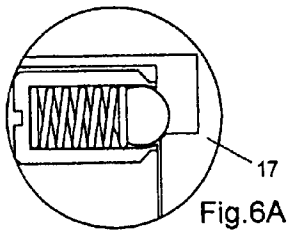
Figure 5:
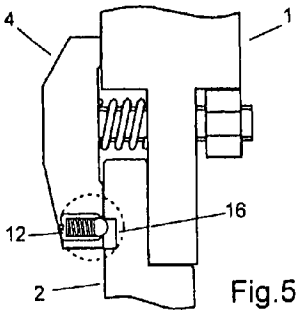
Figure 5A:
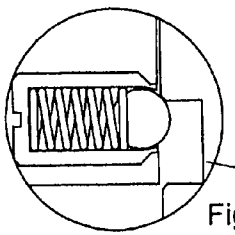
Figure 5B:
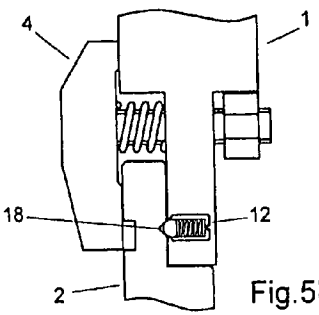

As to the groove, it has a horizontal axis on the front of the press and is allocated:

- according to a first variant (FIGS. 5, 5B and 7, 7B) on a vertical surface of the part of the tool connection inserted in the cavity of the top beam destined to seat the tool connection (see the groove 16 with a rectangular cross section in FIG. 5, and the groove 18 with a V-shaped cross section in the FIGS. 7, 7B and 5B; in the FIGS. 5A and 7A see the enlargements of the parts drawn with a dotted line in the FIGS. 5 and 7;
- according to a second variant (FIG. 6), on the top beam/intermediary within the seating cavity of the tool connection (see the groove 17 with a rectangular cross section in the part drawn with a dotted line in FIG. 6 and shown enlarged in FIG. 6A);
- according to a third variant (FIG. 8) on the tool coupling and uncoupling clamp (see the V-shaped groove 19 in the part drawn with a dotted line in FIG. 8 and shown enlarged in FIG. 8A).

As evidenced in the drawings, the plunger is allocated:

- according to the aforesaid first variant, inside the tool coupling and uncoupling clamp or inside the top beam or intermediary, with its aforesaid aperture opening up to a part of the surface of the clamp or of the top beam or of the intermediary, respectively, that is opposite said groove when the tool is installed;
- according to the aforesaid second and third variant inside the tool connection, with the aforesaid aperture opening up to a part of the surface of the tool connection opposite to said groove.

Each of the drawings in the FIGS. 5-8 shows only one plunger. It is however evident that several plungers may be installed on the same clamp or on the same tool connection, all destined to engage with a same groove.

The plunger is positioned so as to allow the cursor tip to enter into the groove and to press against one rim of the groove itself. Moreover, the spring is chosen and calibrated so that, when the tip in contact with the groove is in a position of maximum entry, the pressure exerted by the same on the cursor is such as to prevent the tool from falling when the relative clamp is in a clamping position.

In the aforesaid first variant, the rim of the groove the cursor tip is pressing against is the upper rim, while in the aforesaid second and third variant it is the lower rim.

As relates to the preferred forms of embodiment shown in the FIGS. 5-8, the following criteria are preferred:

- maximum projection of the spherical cursor from the aperture of the plunger seat: a projection in the range of 30% to 33% of the diameter of the sphere;

angular distance of the two flat surfaces forming the V-shaped grooves of the FIGS. 7 and 8: 90°, as the inclination of the two surfaces is 45° and −45°, respectively:

aperture (distance between the rims) of the V-shaped grooves: about 90% of the diameter of the spherical cursor;

vertical element of the force exerted by the tip on the groove: at least equal to P/n, where "P" is the weight of the tool and "n" is the number of plungers on the clamp, which are pressing against the groove;

number of plungers installed on the same clamp or tool connection: one every 1.5 kg of tool weight.

As relates to the ways of manually assembling and disassembling the tools fitted with the device according to the invention, it was observed that the easiest procedure is to assemble and disassemble the tool by turning it with respect to its operating axis by about 30%, before exerting an upward (loading) force or a downward (unloading) force.

Figure 9:
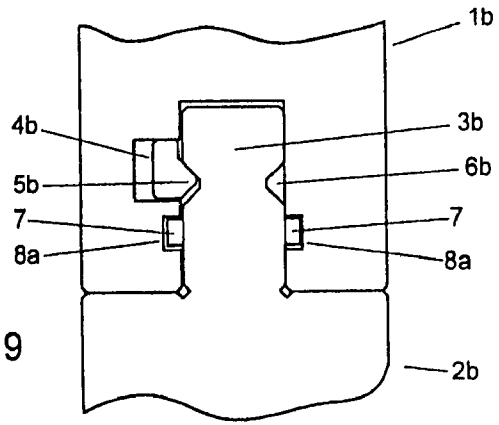
Figure 9C:
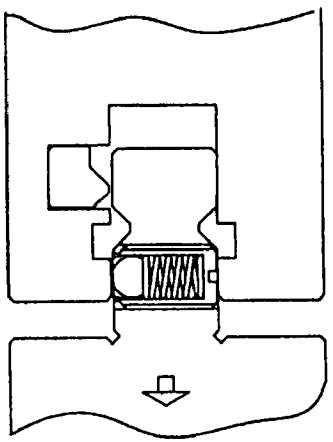
Figure 9B:
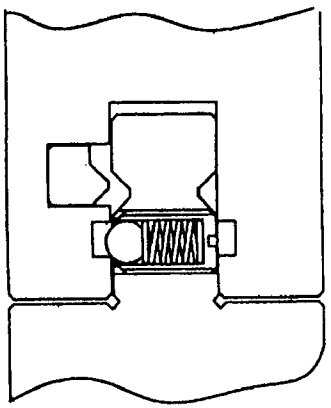
Figure 9A:
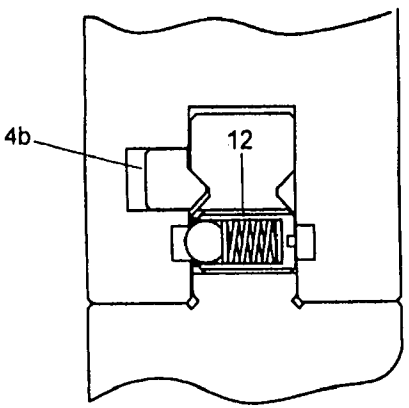

The FIGS. 9A, 9B, 9C show an application example of the invention, capable of converting a lateral connection of the type of FIG. 2 (shown in FIG. 9) into a frontal connection.

This application in fact provides for eliminating the cylindrical pins 7, and replacing them with a plunger 12 inserted into the tool connection.

The FIG. 9A shows the tool clamped by the clamp 4*b*.

The FIG. 9B shows the position of the tool after the clamp has moved to a clamping position: instead of falling, the tool has in fact been kept suspended by the action of the plunger against the lower rim of the groove 8*a*.

The FIG. 9C shows how the plunger appears during the manual tool disassembling operation.

The FIGS. 10A, 10B, 10C and 10D show application examples of the invention, capable of converting a lateral connection of the type used in FIG. 1 (shown in FIG. 10) into a frontal connection.

Figure 10C:
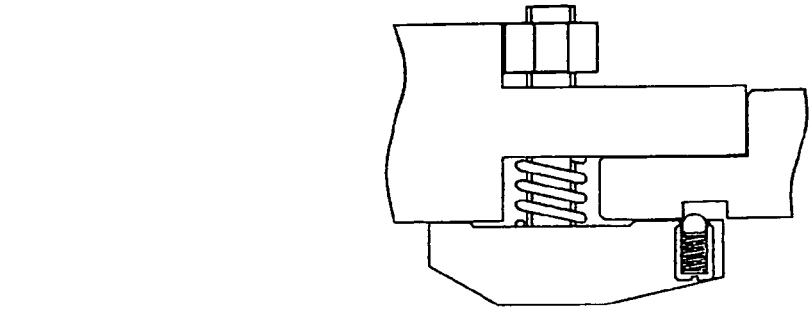
Figure 10D:
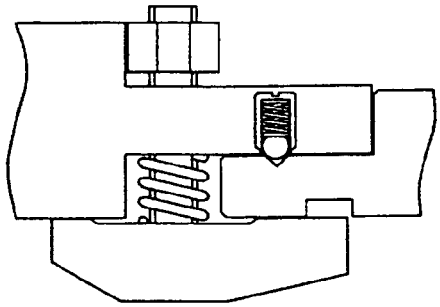
Figure 10B:
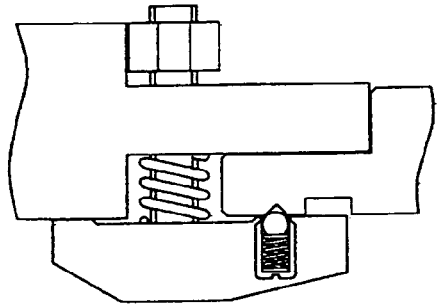
Figure 10A:
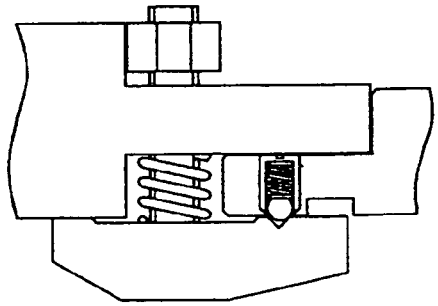
Figure 10:
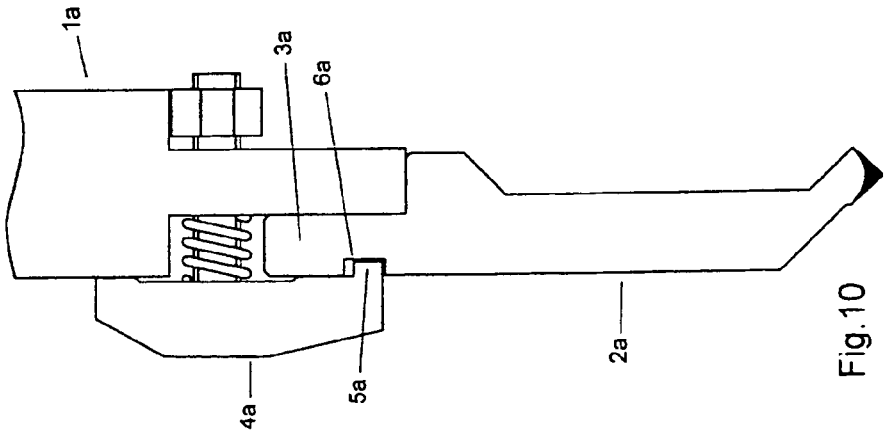

According to these examples the relief 5*a* of the clamp 4*a* is eliminated and replaced:

by a V-shaped groove provided in the clamp and by a plunger inserted into the tool connection according to the example of FIG. 10A;

by a V-shaped groove provided in the tool connection and by a plunger inserted into the clamp according to the example in FIG. 10B;

by a plunger inserted into the clamp in a position capable of engaging the tip of the plunger with the upper rim of the groove 6*a* of the tool connection, according to the example of FIG. 10*c;* by a V-shaped groove provided in the tool connection and by a plunger inserted into the top beam/intermediary according to the example of FIG. 10D.

The FIGS. 11A, 11B, 11C and 11D show application examples of the invention capable of converting a lateral connection of the type used of FIG. 3 (shown in FIG. 11) into a frontal connection.

Figure 11:
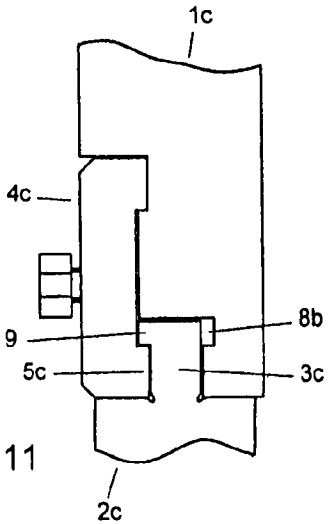
Figure 11D:
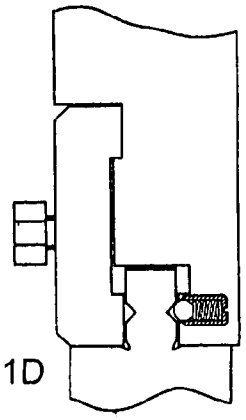
Figure 11C:
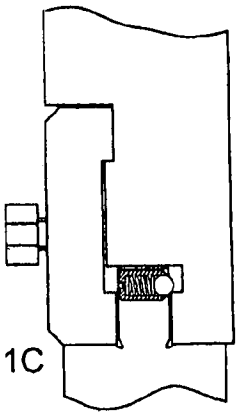
Figure 11B:
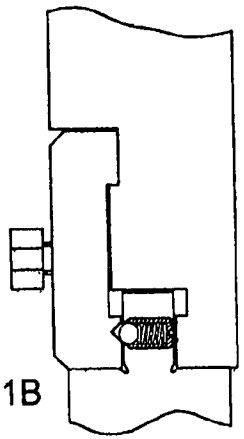
Figure 11A:
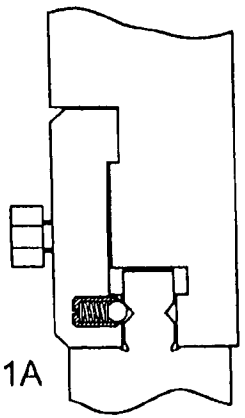

According to these examples, the relief 9 in the tool connection is eliminated and replaced:

by a V-shaped groove provided in the tool connection and by a plunger inserted into the clamp according to the example of FIG. 11A (in FIG. 11A, two opposed grooves are provided on the tool connection, so as to allow installing the tool in two possible positions: that indicated in the figure and that obtained by turning the tool 180° around the axis of the tool connection);

by a V-shaped groove provided in the clamp and a plunger inserted into the tool connection according to the example in FIG. 11B (FIG. 11B shows with dotted lines a second groove on the top beam/intermediary, which is to be provided if an installation of the tool according to two possible positions as in FIG. 11A is desired;

by a plunger inserted into the tool connection in a position capable of engaging the tip of the plunger with the lower rim of the groove 8*b* of the top beam/intermediary, according to the example of FIG. 11*c;* by a V-shaped groove provided in the tool connection and a plunger inserted into the top beam/intermediary according to the example of FIG. 11D.

It is evident that the examples of embodiment described above for descriptive and non limiting purposes are susceptible of many obvious modifications, adaptations, variants and substitutions of some elements with others of a functionally equivalent type, without thereby departing from the spirit of the invention and the scope of the following claims.

The invention claimed is:

1. A quick coupling and uncoupling device of tools to a top beam of a press brake, wherein the press brake comprises a top beam and clamping/unclamping clamps delimiting a cavity;

wherein each tool presents a tool connection and can be attached to the top beam by said clamping/unclamping clamps acting on said tool connection inserted into said cavity; said clamping/unclamping clamps being movable between a clamping position and a releasing position of the tool connection;

wherein the device comprises a plunger, which plunger comprises:

an outer seat fitted with an aperture on one side, a cursor sliding within said seat and presenting a terminal part of a tapered shape partially projecting outside said aperture, a spring located inside said outer seat and pressing the cursor to project outside said aperture with said terminal part;

wherein the device further presents a groove with a horizontal axis, a lower rim and an upper rim, said groove being allocated on a vertical surface of the tool connection inserted into said cavity;

wherein the plunger is allocated inside the clamping/unclamping clamps with its aforesaid aperture opening up to a surface of the clamps which is opposite said groove when the tool is inserted into said cavity;

wherein said cursor is of a spherical form and said groove has a V-shaped cross section;

wherein the plunger is placed so as to allow the aforesaid terminal part of the cursor to enter within said groove and push against the upper rim of the groove, so as to prevent the tool from falling when the clamping/unclamping clamps are in the releasing position.

2. A device according to claim 1, wherein the maximum projection of the cursor from the aperture of the outer seat of the plunger is in the range of 30% to 33% of the diameter of the cursor.

3. A device according to claim 1, wherein the angular distance of the two flat surfaces forming the V-shaped groove is 90°, the inclination of the two surfaces being 45° and −45°, respectively, with respect to an horizontal plane.

4. A device according to claim 1, wherein the distance between the upper rim and the lower rim of the V-shaped groove is equal to about 90% of a diameter of the spherical cursor.

5. A device according to claim 1, wherein when the aforesaid terminal part of the cursor is in a maximum entry position in the groove, a pressure exerted by the groove on the cursor is such that the vertical component of the force exerted on the groove is at least equal to P/n, where "P" is the weight of the tool and "n" is the number of plungers present on the clamp and pressing against the groove.

6. A device according to claim 1, wherein the number of plungers is one every 1.5 kg of tool weight.

7. A device according to claim 1 wherein the press brake comprises an intermediary mounted on the top beam and delimiting together with the clamping/unclamping clamps said cavity instead of said top beam.

8. A quick coupling and uncoupling device of tools to a top beam of a press brake, wherein the press brake comprises a top beam and clamping/unclamping clamps delimiting a cavity;

wherein each tool presents a tool connection and can be attached to the top beam by said clamping/unclamping clamps acting on said tool connection inserted into said cavity; said clamping/unclamping clamps being movable between a clamping position and a releasing position of the tool connection;

wherein the device comprises a plunger, which plunger comprises:

an outer seat fitted with an aperture on one side, a cursor sliding within said seat and presenting a terminal part of a tapered shape partially projecting outside said aperture, a spring located inside said outer seat and pressing the cursor to project outside said aperture with said terminal part;

wherein the device further presents a groove with a horizontal axis a lower rim and an upper rim, said groove being allocated on a vertical surface of the tool connection inserted into said cavity;

wherein the plunger is allocated inside the top beam with its aforesaid aperture opening up to a surface of the top beam which is opposite said groove when the tool is inserted into said cavity;

wherein said cursor is of a spherical form and said groove has a V-shaped cross section;

wherein the plunger is placed so as to allow the aforesaid terminal part of the cursor to enter within said groove and push against the upper rim of the groove, so as to prevent the tool from falling when the clamping/unclamping clamps are in the releasing position.

9. A device according to claim 8, wherein the maximum projection of the cursor from the aperture of the outer seat of the plunger is in the range of 30% to 33% of the diameter of the cursor.

10. A device according to claim 8, wherein the angular distance of the two flat surfaces forming the V-shaped groove is 90°, the inclination of the two surfaces being 45° and −45°, respectively, with respect to an horizontal plane.

11. A device according to claim 8, wherein the distance between the upper rim and the lower rim of the V-shaped groove is equal to about 90% of a diameter of the spherical cursor.

12. A device according to claim 8, wherein when the aforesaid terminal part of the cursor is in a maximum entry position in the groove, a pressure exerted by the groove on the cursor is such that the vertical component of the force exerted on the groove is at least equal to P/n, where "P" is the weight of the tool and "n" is the number of plungers present on the clamp and pressing against the groove.

13. A device according to claim 8, wherein the number of plungers is one every 1.5 kg of tool weight.

14. A device according to claim 8 wherein the press brake comprises an intermediary mounted on the top beam and delimiting together with the clamping/unclamping clamps said cavity instead of said top beam; wherein the plunger is allocated inside the intermediary with its aforesaid aperture opening up to a surface of the intermediary which is opposite said groove when the tool is inserted into said cavity.

15. A quick coupling and uncoupling device of tools to a top beam of a press brake, wherein the press brake comprises a top beam and clamping/unclamping clamps delimiting a cavity;

wherein each tool presents a tool connection and can be attached to the top beam by said clamping/unclamping clamps acting on said tool connection inserted into said cavity; said clamping/unclamping clamps being movable between a clamping position and a releasing position of the tool connection;

wherein the device comprises a plunger, which plunger comprises:

an outer seat fitted with an aperture on one side, a cursor sliding within said seat and presenting a terminal part of a tapered shape partially projecting outside said aperture, a spring located inside said outer seat and pressing the cursor to project outside said aperture with said terminal part;

wherein the device further presents a groove with a horizontal axis a lower rim and an upper rim, said groove being allocated on the top beam inside said cavity;

wherein the plunger is allocated inside the tool connection with its aforesaid aperture opening up to a tool connection surface which is opposite said groove when the tool is inserted into said cavity;

wherein said cursor is of a spherical form and said groove has a V-shaped cross section;

wherein the plunger is placed so as to allow the aforesaid terminal part of the cursor to enter within said groove and push against the lower rim of the groove, so as to prevent the tool from falling when the clamping/unclamping clamps are in the releasing position.

16. A device according to claim 15, wherein the maximum projection of the cursor from the aperture of the outer seat of the plunger is in the range of 30% to 33% of the diameter of the cursor.

17. A device according to claim 15, wherein the angular distance of the two flat surfaces forming the V-shaped groove is 90°, the inclination of the two surfaces being 45° and −45°, respectively, with respect to an horizontal plane.

18. A device according to claim 15, wherein the distance between the upper rim and the lower rim of the V-shaped groove is equal to about 90% of a diameter of the spherical cursor.

19. A device according to claim 15, wherein when the aforesaid terminal part of the cursor is in a maximum entry position in the groove, a pressure exerted by the groove on the cursor is such that the vertical component of the force exerted on the groove is at least equal to P/n, where "P" is the weight of the tool and "n" is the number of plungers present on the clamp and pressing against the groove.

20. A device according to claim 15, wherein the number of plungers is one every 1.5 kg of tool weight.

21. A device according to claim 15 wherein the press brake comprises an intermediary mounted on the top beam and delimiting together with the clamping/unclamping clamps said cavity instead of said top beam; wherein said groove is allocated on the intermediary inside said cavity.

22. A quick coupling and uncoupling device of tools to a top beam of a press brake, wherein the press brake comprises a top beam and clamping/unclamping clamps delimiting a cavity;

wherein each tool presents a tool connection and can be attached to the top beam by said clamping/unclamping clamps acting on said tool connection inserted into said cavity; said clamping/unclamping clamps being movable between a clamping position and a releasing position of the tool connection;

wherein the device comprises a plunger, which plunger comprises:

an outer seat fitted with an aperture on one side, a cursor sliding within said seat and presenting a terminal part of a tapered shape partially projecting outside said aperture, a spring located inside said outer seat and pressing the cursor to project outside said aperture with said terminal part;

wherein the device further presents a groove with a horizontal axis a lower rim and an upper rim, said groove being allocated on the clamping/unclamping clamps inside the cavity;

wherein the plunger is allocated inside the tool connection with its aforesaid aperture opening up to a tool connection surface which is opposite said groove when the tool is inserted into said cavity;

wherein said cursor is of a spherical form and said groove has a V-shaped cross section;

wherein the plunger is placed so as to allow the aforesaid terminal part of the cursor to enter within said groove and push against the lower rim of the groove, so as to prevent the tool from falling when the clamping/unclamping clamps are in the releasing position.

23. A device according to claim 22, wherein the maximum projection of the cursor from the aperture of the outer seat of the plunger is in the range of 30% to 33% of the diameter of the cursor.

24. A device according to claim 22, wherein the angular distance of the two flat surfaces forming the V-shaped groove is 90°, the inclination of the two surfaces being 45° and −45°, respectively, with respect to an horizontal plane.

25. A device according to claim 22, wherein the distance between the upper rim and the lower rim of the V-shaped groove is equal to about 90% of a diameter of the spherical cursor.

26. A device according to claim 22, wherein when the aforesaid terminal part of the cursor is in a maximum entry position in the groove, a pressure exerted by the groove on the cursor is such that the vertical component of the force exerted on the groove is at least equal to P/n, where "P" is the weight of the tool and "n" is the number of plungers present on the clamp and pressing against the groove.

27. A device according to claim 22, wherein the number of plungers is one every 1.5 kg of tool weight.

28. A device according to claim 22 wherein the press brake comprises an intermediary mounted on the top beam and delimiting together with the clamping/unclamping clamps said cavity instead of said top beam.

* * * * *

UNITED STATES PATENT AND TRADEMARK OFFICE

CERTIFICATE OF CORRECTION

PATENT NO. : 7,634,935 B2
APPLICATION NO. : 11/543479
DATED : December 22, 2009
INVENTOR(S) : Domenico Mazzocchi It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 578 days.

Signed and Sealed this

Ninth Day of November, 2010

David J. Kappos

David J. Kappos
*Director of the United States Patent and Trademark Office*